US010780011B2

(12) United States Patent
Yang et al.

(10) Patent No.: US 10,780,011 B2
(45) Date of Patent: Sep. 22, 2020

(54) FINGER JOINT REHABILITATION EXERCISE AID PART

(71) Applicants: BEIJING HENGTONG XINJIA TECHNOLOGY DEVELOPMENT CO, LTD., Beijing (CN); ZHONGSHAN CHANGYAO MEDICAL EQUIPMENT CO, LTD., Zhongshan (CN)

(72) Inventors: Keqiang Yang, Beijing (CN); Zhenwei Mao, Beijing (CN); Keijiron Yamamoto, Kanagawa (JP)

(73) Assignees: BEIJING HENGTONG XINJIA TECHNOLOGY DEVELOPMENT CO, LTD., Beijing (CN); ZHONGSHAN CHANGYAO MEDICAL EQUIPMENT CO, LTD., Zhongshan (CN)

( * ) Notice: Subject to any disclaimer, the term of this patent is extended or adjusted under 35 U.S.C. 154(b) by 0 days.

(21) Appl. No.: 16/626,579

(22) PCT Filed: Jul. 3, 2018

(86) PCT No.: PCT/CN2018/094199

§ 371 (c)(1),
(2) Date: Dec. 26, 2019

(87) PCT Pub. No.: WO2019/007314

PCT Pub. Date: Jan. 10, 2019

(65) Prior Publication Data

US 2020/0129364 A1 Apr. 30, 2020

(30) Foreign Application Priority Data

Jul. 7, 2017 (CN) ..... 2017 1 0552259

(51) Int. Cl.
*A61H 1/00* (2006.01)
*A61H 1/02* (2006.01)

(52) U.S. Cl.
CPC ..... *A61H 1/0288* (2013.01); *A61H 1/024* (2013.01); *A61H 1/0277* (2013.01);
(Continued)

(58) Field of Classification Search
CPC ..... B25J 9/104; B25J 9/1694; B25J 9/0006; A61H 3/00; A61H 1/0288;
(Continued)

(56) References Cited

U.S. PATENT DOCUMENTS 4,274,399 A * 6/1981 Mummert ..... A61H 1/0288 601/40
4,671,258 A * 6/1987 Barthlome ..... A61H 1/0288 128/DIG. 20

(Continued)

FOREIGN PATENT DOCUMENTS

CN 204121369 U 1/2015
CN 205698416 * 11/2016 ..... A61H 1/02
CN 205698416 U 11/2016
CN 106880470 A 6/2017
CN 107184365 A 9/2017
WO WO-2015191007 A1 * 12/2015 ..... A61H 1/0288

(Continued)

OTHER PUBLICATIONS

English Translation for CN205698416, translated by espacenet.com, translated on May 25, 2020.*

*Primary Examiner* — Tu A Vo
(74) *Attorney, Agent, or Firm* — Bayramoglu Law Offices LLC

(57) ABSTRACT

A finger joint rehabilitation exercise aid part includes a rubber part, at least one small bracket, one middle bracket and one large bracket. The small bracket, the middle bracket and the large bracket are fixed on the rubber part and are provided with a fixing hole for fixing a power source. A front end of the rubber part is provided with a finger sheath, and
(Continued)

the patient's finger can reach into the finger sheath. As such, according to the finger joint rehabilitation exercise aid part, the rubber part is sheathed on the patient's finger. The rubber part is forced by the power source to bend and straighten and drives the patient's fingers to perform exercise at the same time, thus helping patients perform rehabilitation training.

6 Claims, 8 Drawing Sheets

(52) U.S. Cl.
CPC ..... *A61H 2201/0107* (2013.01); *A61H 2201/0157* (2013.01); *A61H 2201/1238* (2013.01); *A61H 2201/1409* (2013.01); *A61H 2201/165* (2013.01); *A61H 2201/1638* (2013.01); *A61H 2205/06* (2013.01); *A61H 2205/067* (2013.01); *A61H 2205/10* (2013.01); *A61H 2205/102* (2013.01)

(58) Field of Classification Search
CPC .... A61H 2201/1238; A61H 2201/1409; A61H 2201/1638; A61H 2201/165; A61H 1/00; A61H 1/02; A61F 5/10
See application file for complete search history.

(56) References Cited

U.S. PATENT DOCUMENTS

| | | | | |
|---|---|---|---|---|
| 6,565,563 | B1 * | 5/2003 | Agee | A61B 17/6425 602/21 |
| 2010/0280424 | A1 * | 11/2010 | Kawakami | B25J 9/0006 601/33 |
| 2012/0029399 | A1 * | 2/2012 | Sankai | A61H 1/0288 601/40 |
| 2013/0226350 | A1 * | 8/2013 | Bergelin | A61H 1/0288 700/275 |
| 2015/0290794 | A1 * | 10/2015 | Griffith | A61H 1/0277 414/4 |
| 2016/0252110 | A1 * | 9/2016 | Galloway | A61F 2/68 60/327 |
| 2017/0020763 | A1 | 1/2017 | Cruz | |
| 2018/0079071 | A1 * | 3/2018 | Griffith | A61H 1/0237 |
| 2018/0296419 | A1 * | 10/2018 | Tong | A61H 1/02 |
| 2019/0015233 | A1 * | 1/2019 | Galloway | A61F 5/05816 |
| 2019/0056248 | A1 * | 2/2019 | Shepherd | B25J 9/142 |

FOREIGN PATENT DOCUMENTS

| | | | | |
|---|---|---|---|---|
| WO | WO-2016056058 | A1 * | 4/2016 | A61H 1/02 |
| WO | WO-2016140115 | A1 * | 9/2016 | A61H 1/02 |
| WO | WO-2017199834 | A1 * | 11/2017 | A61H 1/02 |

* cited by examiner

FINGER JOINT REHABILITATION EXERCISE AID PART

CROSS REFERENCE TO THE RELATED APPLICATIONS

This application is the national phase entry of International Application No. PCT/CN2018/094199, filed on Jul. 3, 2018, which is based upon and claims priority to Chinese Patent Application No. 201710552259.0, filed on Jul. 7, 2017, the entire contents of which are incorporated herein by reference.

TECHNICAL FIELD

The present invention relates to the technical field of joint exercise aid, and in particular to a finger joint rehabilitation exercise device.

BACKGROUND

It has been clinically confirmed that during early rehabilitation and spontaneous recovery after surgery on a patient's limb or for a patient suffering from injury of cranial nerves, implementation of continuous passive exercise can compensate for patient's lack of active exercise, increase the mobility of the limb, and reduce corresponding complications at the same time. In addition, at present, patients suffer from contracture of fingers due to finger paralysis caused by central nervous injury such as cerebral infarction, in which case, if the patient's fingers can be assisted in exercise, the recovery speed of patient's fingers can be increased.

In view of the above defects, the inventor of the present invention finally obtained the present invention after a long period of research and practice.

SUMMARY

To solve the above technical defects, the technical solution used by the present invention is to provide a finger joint rehabilitation exercise aid part, comprising:

a rubber part, at least one small bracket, one middle bracket and one large bracket, wherein the small bracket, the middle bracket and the large bracket are fixed on the rubber part, with the positions of the small bracket, the middle bracket and the large bracket fixed on the rubber part respectively corresponding to a distal phalanx/middle phalanx, a proximal phalanx and a metacarpal bone;

a front end of the rubber part is provided with a finger sheath into which the patient's finger can reach.

Preferably, the small bracket, the middle bracket and the large bracket are all provided with a fixing hole for fixing the power source.

Preferably, a front end of the finger sheath has an opening from which the patient's finger can reach out, improving the patient's finger touch.

Preferably, the rubber part is provided with at least four raised cylinders, and the small bracket, the middle bracket and the large bracket are all provided with holes that cooperate with the cylinders.

Preferably, when the small bracket, the middle bracket and the large bracket are fixed on the rubber part, a ring hole is provided in the rubber part between the small bracket and the middle bracket and/or between the middle bracket and the large bracket for improving the flexibility of the rubber part.

Preferably, a curved surface (116) on the reverse side of the rubber part has a greater curvature than a curved surface (117), facilitating fitting to the patient's finger.

Preferably, the finger sheath is provided with a flat face segment for supporting the finger.

Preferably, the small bracket, the middle bracket and the large bracket are all made of a lightweight material.

Preferably, the material of the rubber part is rubber.

Compared with the prior art, the beneficial effect of the present invention is as follows: According to the finger joint rehabilitation exercise aid part, the rubber part is sheathed on the patient's finger, the power source is fixed by means of the small bracket, the middle bracket and the large bracket fixed on the rubber part, and the rubber part is forced by the power source to bend and straighten and drives the patient's fingers to perform exercise at the same time, thus helping patients perform rehabilitation training.

BRIEF DESCRIPTION OF THE DRAWINGS

To illustrate the technical solutions in various embodiments of the present invention more clearly, the accompanying drawings to be used in the description of the embodiments will be briefly introduced below.

DETAILED DESCRIPTION OF THE EMBODIMENTS

The above and other technical features and advantages of the present invention will be illustrated in more detail below with reference to the drawings.

[Skeletal Structure]

Before illustration for a joint exercise aid device involved in this embodiment, the skeletal structure of a human hand will be illustrated.

Figure 1:
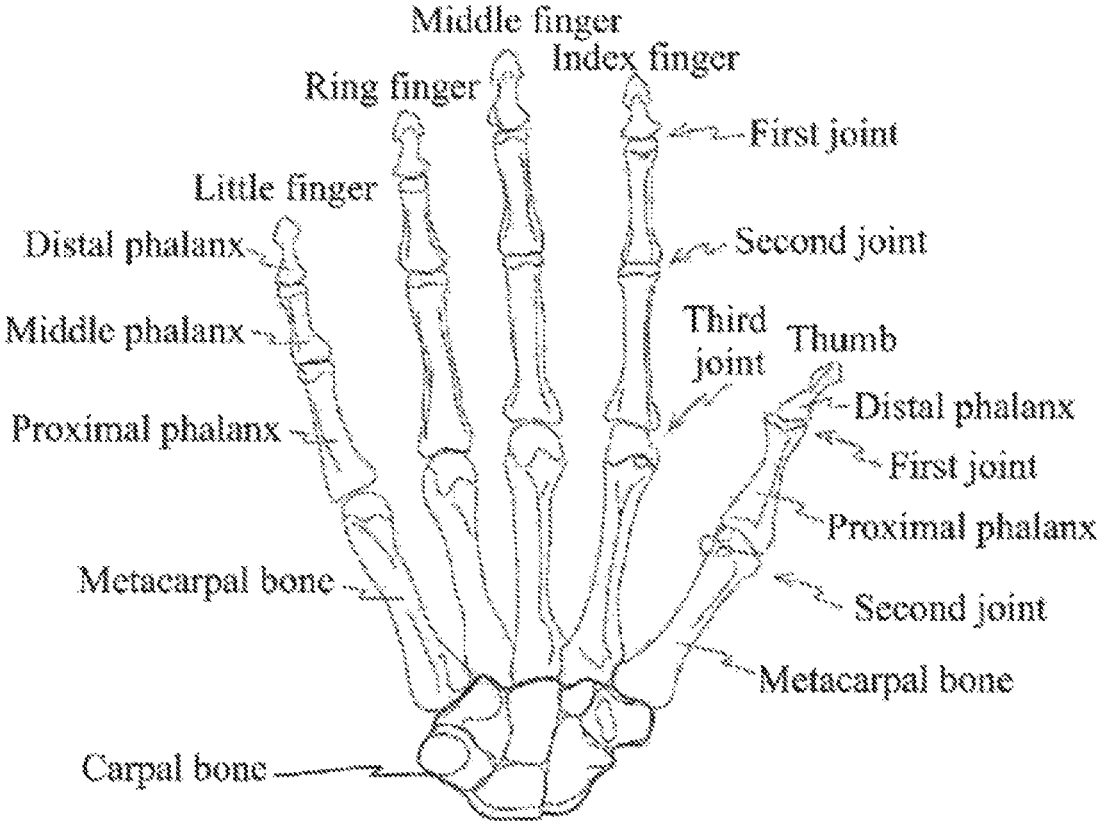
FIG. 1 is a diagram for illustrating the skeletal structure of a human hand.

FIG. 1 is the skeletal structure of a right hand viewed from a palm side. The skeletal structure of a right hand is shown in FIG. 1, in which metacarpal bones of a thumb, an index finger, a middle finger, a ring finger and a little finger are connected to a carpal bone. The metacarpal bone of the thumb is connected to phalanges composed of a "proximal phalanx" and a "distal phalanx". Regarding the thumb, the distal phalanx of a fingertip is connected to the proximal phalanx through a "first joint", and the proximal phalanx is connected to the metacarpal bone of the thumb through a "second joint".

In addition, metacarpal bones of the index finger, middle finger, ring finger and little finger are respectively connected to phalanges composed of a "proximal phalanx", a "middle phalanx" and a "distal phalanx". Regarding the index finger, the middle finger, the ring finger and the little finger, the distal phalanx of the fingertip is connected to the middle phalanx through a "first joint", and the middle phalanx is connected to the proximal phalanx through a "second joint". Moreover, the proximal phalanx is connected to the metacarpal bone through a "third joint". Furthermore, in the following illustration, the part of a finger where a distal phalanx is used as a bone is referred to as a "distal part", and the part of a finger where a middle phalanx is used as a bone is referred to as a "middle part". In addition, the part of a finger where a proximal phalanx is used as a bone is referred to as a "proximal part". Also, the part where a "metacarpal bone" is used as a bone is referred to as a "metacarpal part".

[Structure of Finger Joint Rehabilitation Exercise Aid Part]

Figure 2:
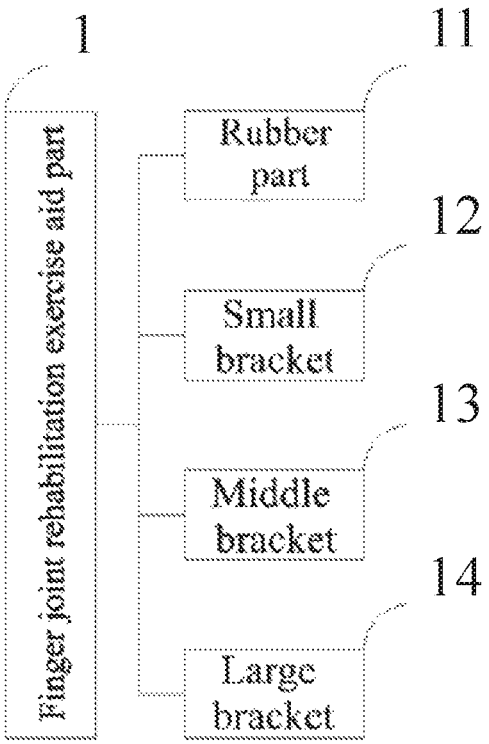
FIG. 2 is a frame diagram of a finger joint rehabilitation exercise aid part.

FIG. 2 is a frame diagram of a finger joint rehabilitation exercise aid part, which comprises a rubber part 11, a small bracket 12, a middle bracket 13 and a large bracket 14. The small bracket 12, the middle bracket 13 and the large bracket 14 are all fixed on the rubber part 11, and a power source corrugated tube 3 is fixed by means of a small bracket 12, the middle bracket 13 and the large bracket 14.

The finger joint rehabilitation exercise aid part can be worn on each finger, but the fingers are different in length and bone structure such that the rubber part structure and the number of small brackets to be worn on each finger will be different. Since the distal phalanx of each finger is short, the power source, such as a corrugated tube, is fixed with a small bracket 12, the distal phalanx of the finger is forced to exercise under the action of the power source, and the fixed position of the small bracket 12 on the rubber part corresponds to the distal phalanx of the finger. The index finger, the middle finger, the ring finger and the little finger all have a middle phalanx, and since the middle phalanx is slightly shorter than the proximal phalanx, the power source is also fixed with a small bracket 12 to prevent the power source from being detached from the rubber part and thus not being able to drive the finger by means of the rubber part, and at this moment the fixed position of the small bracket 12 on the rubber part is in the middle of the middle phalanx of the finger. The five fingers of one hand all have a proximal phalanx, since the proximal phalanx is longer than the middle phalanx, in order to bring the power source more fit to the finger, a middle bracket 13 is provided on the rubber part to be worn on the thumb at the position of the proximal phalanx close to first joint so as to fix the power source, and in addition, middle brackets 13 are provided on the rubber parts to be worn on the index finger, the middle finger, the ring finger and the little finger at the position of the corresponding middle phalanx close to the second joint so as to fix the power source. The large brackets 14 are provided on the rubber part to be worn on the five fingers at positions respectively corresponding to the end of the proximal phalanx and the metacarpal bone so as to fix the power source. As such, one small bracket 12, one middle bracket 13 and one large bracket 14 are provided on the rubber part to be worn on the thumb, and two small brackets 12, one middle bracket 13 and one large bracket 14 are provided on the other four fingers, such that the rubber part to be worn on the thumb is different in structure from the rubber parts to be worn on the other four fingers.

[Structure of Finger Joint Rehabilitation Exercise Aid Parts on the Index Finger, the Middle Finger, the Ring Finger and the Little Finger]

Figure 3:
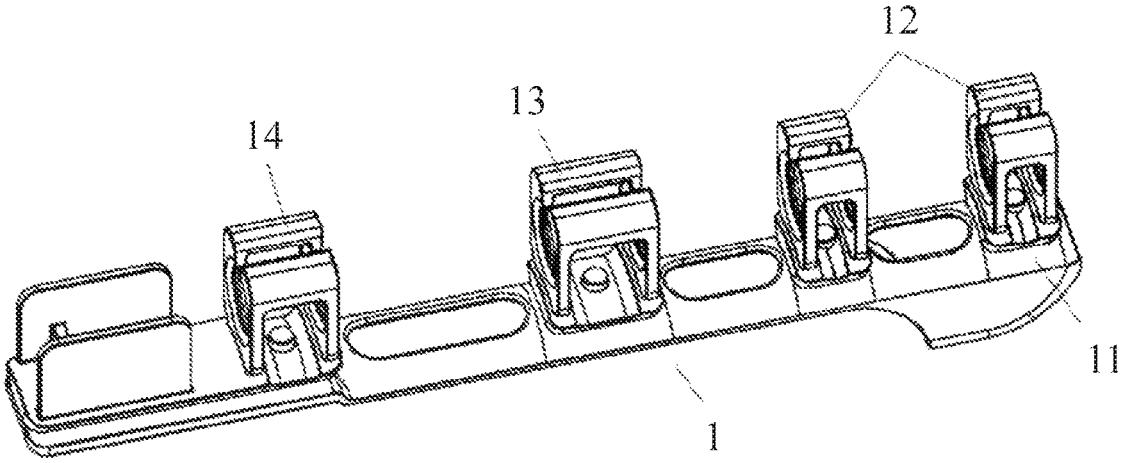
FIG. 3 is a structural diagram of a finger joint rehabilitation exercise aid part to be worn on an index finger, a middle finger, a ring finger and a little finger.

FIG. 3 is a structural diagram of a finger joint rehabilitation exercise aid part, which can be worn on the index finger, the middle finger, the ring finger and the little finger, which comprises a rubber part 11, a small bracket 12, a middle bracket 13 and a large bracket 14. The small bracket 12, the middle bracket 13 and the large bracket 14 are all fixed on the rubber part 11.

Figure 4:
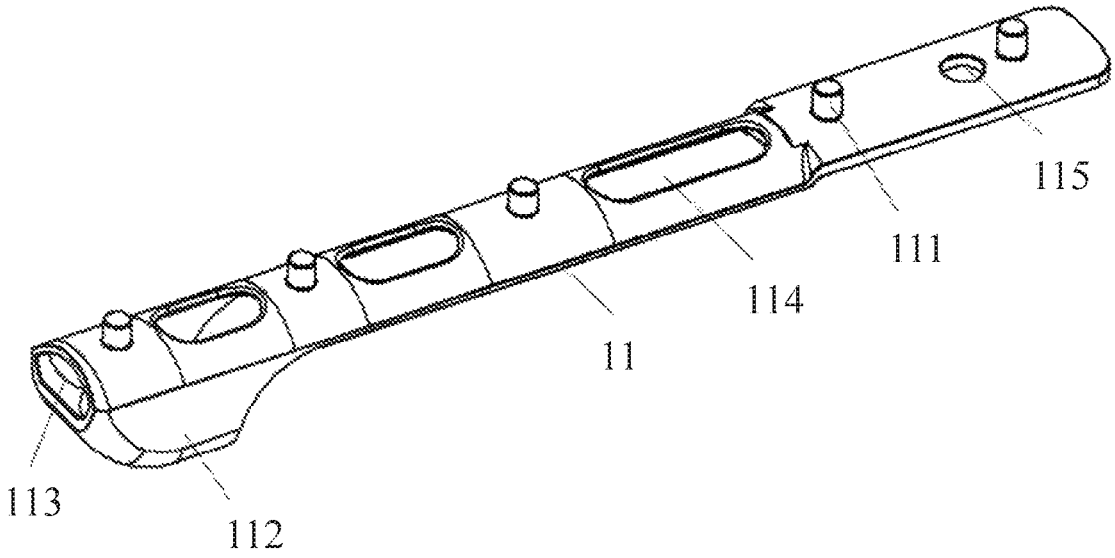
FIG. 4 is a front view of a rubber part to be worn on an index finger, a middle finger, a ring finger and a little finger.
Figure 5:
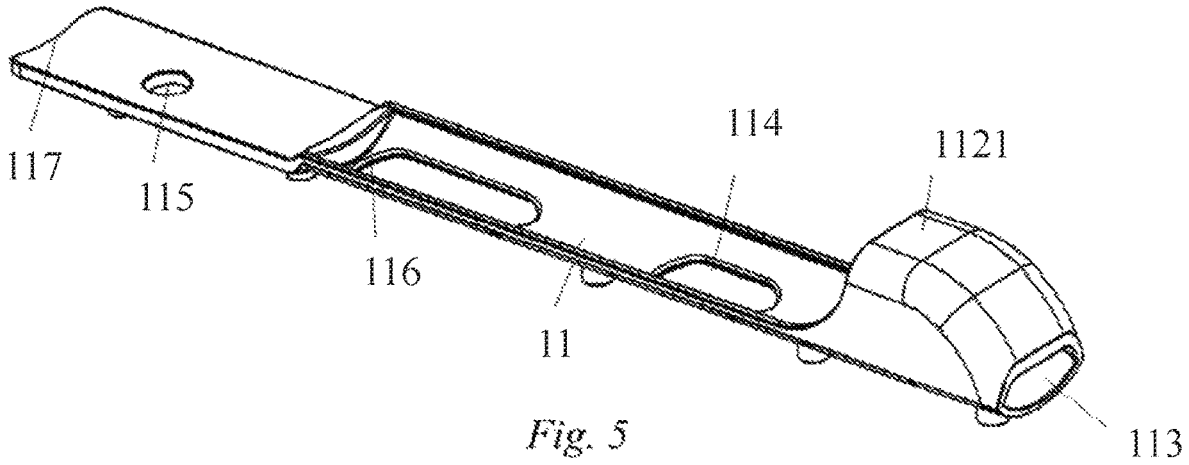
FIG. 5 is a reverse view of a rubber part to be worn on an index finger, a middle finger, a ring finger and a little finger.

The rubber part 11 can be sheathed on a patient's finger, and the material thereof is rubber, especially medical silicone, and has strong flexibility to adapt to different deformation of the patient's finger. FIGS. 4 and 5 are respectively the front side and the reverse side of the rubber part 11. The front side of the rubber part 11 is provided with multiple raised cylinders 111 for fixing the small bracket 12, the middle bracket 13 and the large bracket 14 to the rubber part 11, with the number of the raised cylinders 111 being the same as the total number of the small bracket 12, the middle bracket 13 and the large bracket 14. A front end of the rubber part 11 has a finger sheath 112, which is open at a front end thereof, that is, the rubber part 11 has an open end 113, and the patient's finger reaches into the finger sheath 12 and out from the open end 113, so that the patient's finger is exposed, which can improve the patient's finger touch and is advantageous for the rehabilitation of the patient's fingers. The finger sheath 112 is provided, at a position where it is in contact with the finger pulp, with a flat face segment 1121 for supporting the finger, and the finger is kept straight when it is forced to straighten under the drive of the power source. A ring opening 114 is provided between the small bracket 12 and the middle bracket 13 and/or between the middle bracket 13 and the large bracket 14 on the rubber part 11, which improves the flexibility of the rubber part at the periphery of the ring opening 114, and when the patient's finger bends and spreads, the rubber part 11 with the ring opening 114 tightly fits with the patient's finger, which is more helpful for the patient to perform follow action with the aid of the finger joint rehabilitation exercise aid part, facilitating rehabilitation of the patient. The rubber part 11 is further provided with a hole 115 for fixing the rubber part 11 to other aid structures through the hole 115. The curvature of a curved surface 116 of the back side of the rubber part 11 cooperating with the finger is greater than that of a curved surface 117, which facilitates closely fitting to the patient's finger, such that when the rubber part 11 is driven by the power source to bend and stretch, the patient's finger can accurately and synchronously move therewith without lag, and the curvature of the curved surface 117 is smaller for fixedly connection with other aid parts.

Figure 6:
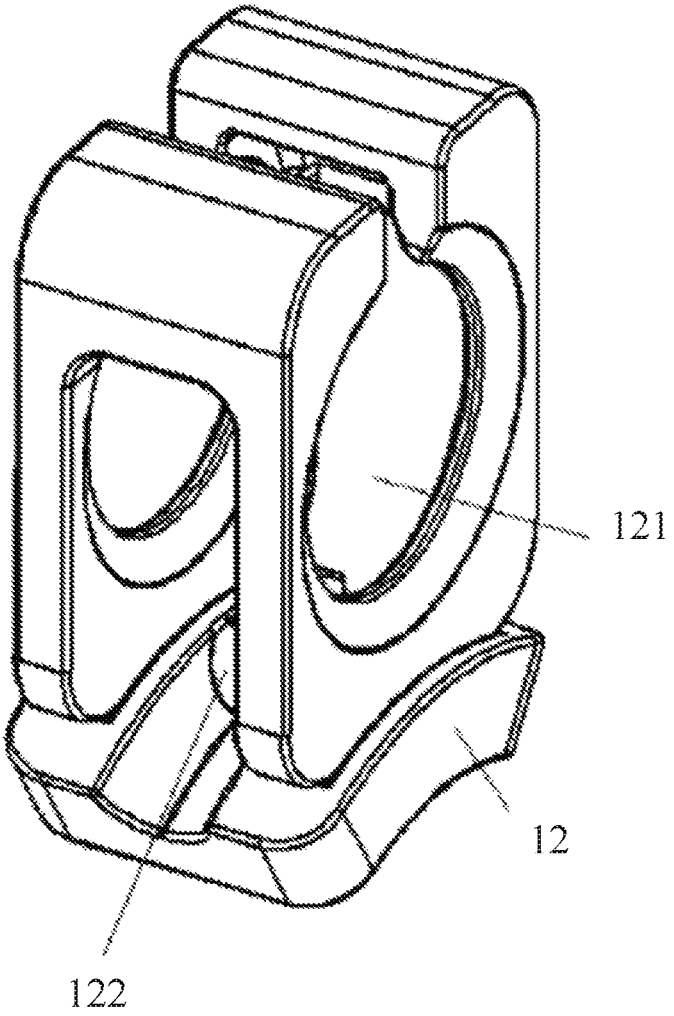
FIG. 6 is a structural diagram of a small bracket.
Figure 7:
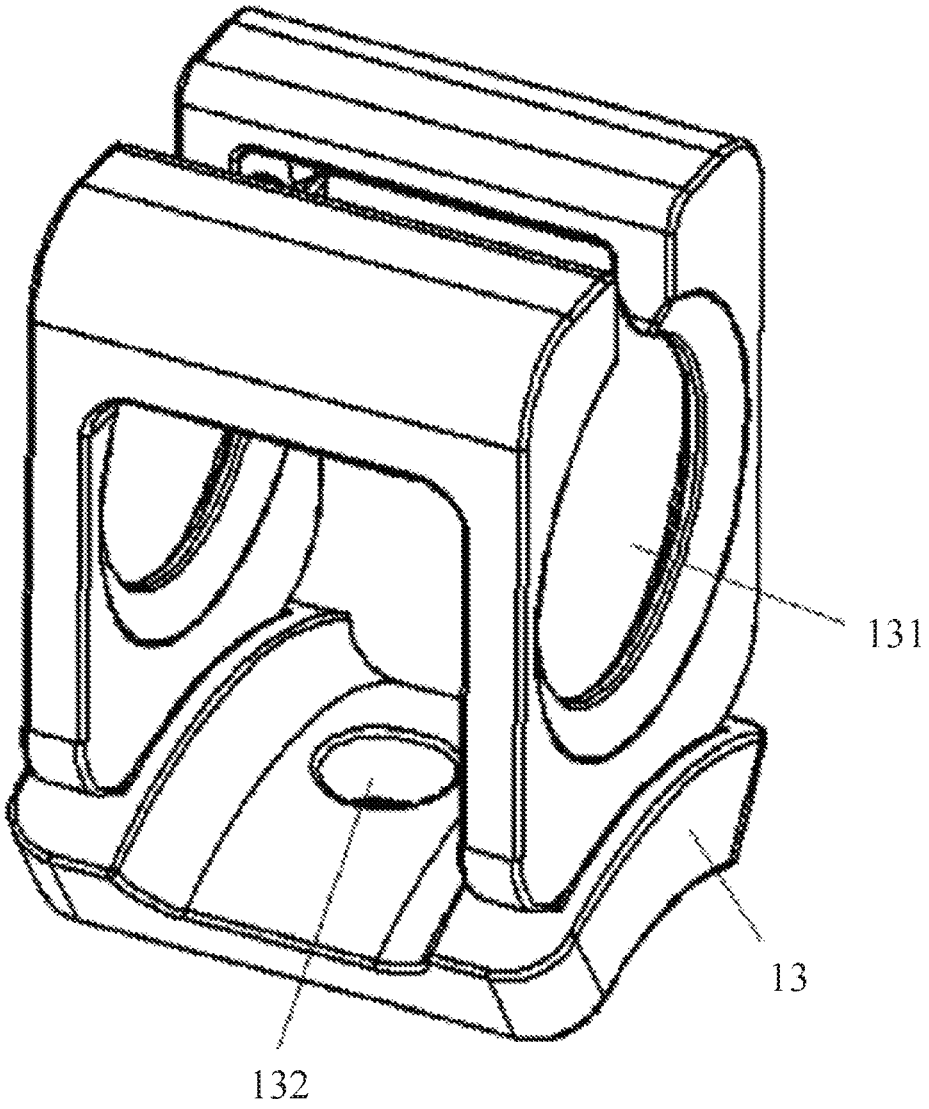
FIG. 7 is a structural diagram of a middle bracket.
Figure 8:
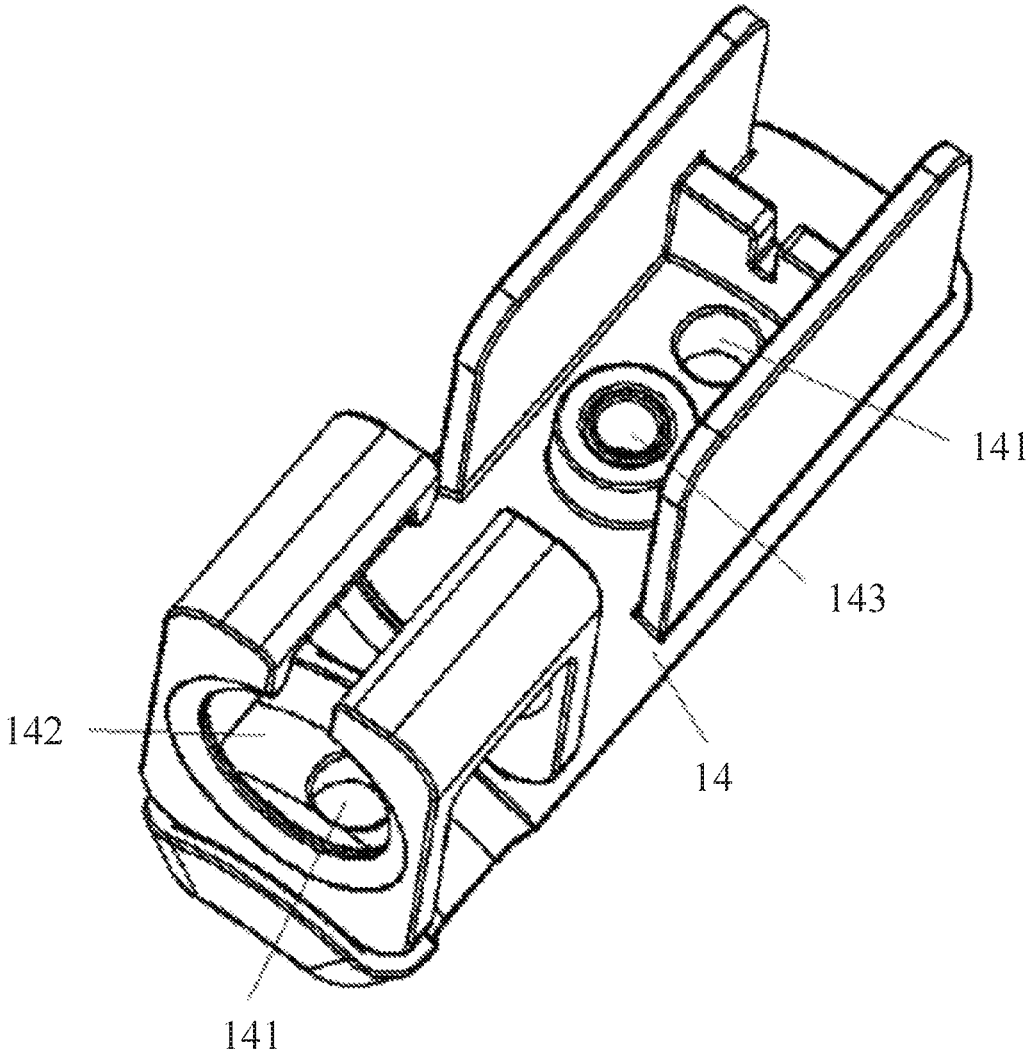
FIG. 8 is a structural diagram of a large bracket.

FIGS. 6, 7 and 8 are respectively structural diagrams of the small bracket 12, the middle bracket 13 and the large bracket 14. In FIG. 6, the small bracket 12 has a fixing hole 121 such that a power source, such as a corrugated tube, that forces the rubber part 11 to bend and straighten is placed into the fixing hole 121 and is fixed, and a fixing hole 122 that cooperates with the cylinder 111 such that when the cylinder 111 extends into the hole 122, the small bracket is fixed onto the rubber part 11.

The structure of the middle bracket 13 is the same as that of the small bracket 12, except that when the middle bracket 13 and the small bracket 12 are fixed on the rubber part 11, the length of the middle bracket 13 in the lengthwise direction of the finger is greater than the length of the small bracket 12, the middle bracket 13 is further provided with a fixing hole 131 such that a power source, such as a corrugated tube, that forces the rubber part 11 to bend and straighten, is placed into the large hole 131 and is fixed, and a fixing hole 132 that cooperates with the cylinder 111 such that the middle bracket is fixed on the rubber part 11.

The large bracket 14 is different in structure from the small bracket 12 and the middle bracket 13, the large bracket 14 has a greater length and is provided with two holes 141 that cooperate with the cylinder 111 to facilitate fixing the large bracket 14 onto the rubber part 11. The large bracket is further provided with a fixing hole 142 such that a power source, such as a corrugated tube, that forces the rubber part 11 to bend and straighten is placed into the large hole 142 and is fixed, and a hole 143 through which the large bracket 14, the rubber part 11 and other aid parts are fixed together.

Since the small bracket 12, the middle bracket 13 and the large bracket 14 need to be worn for a long time, the materials thereof are all lightweight materials, such as plastic.

The finger joint rehabilitation exercise aid parts on the index finger, the middle finger, the ring finger and the little finger have the same structure, but the four fingers are different in length, so that the length of the rubber parts will be different, and the distance between the corresponding cylinders 111 will be adjusted.

The finger joint rehabilitation exercise aid part is driven by the power source to bend and stretch and at the same time drives the patient's fingers to perform bending and stretching exercise, thereby helping the patient perform rehabilitation training.

[Structure of Finger Joint Rehabilitation Exercise Aid Part on the Thumb]

The difference between the finger joint rehabilitation exercise aid part to be worn on the thumb and the finger joint rehabilitation exercise aid parts to be worn on other fingers lies in that one small bracket is fixed on the rubber part to be worn on the thumb, and two small brackets are fixed on the rubber part to be worn on other fingers, so the rubber parts to be worn on the thumb have different technical features from the rubber parts to be worn on other fingers.

Figure 9:
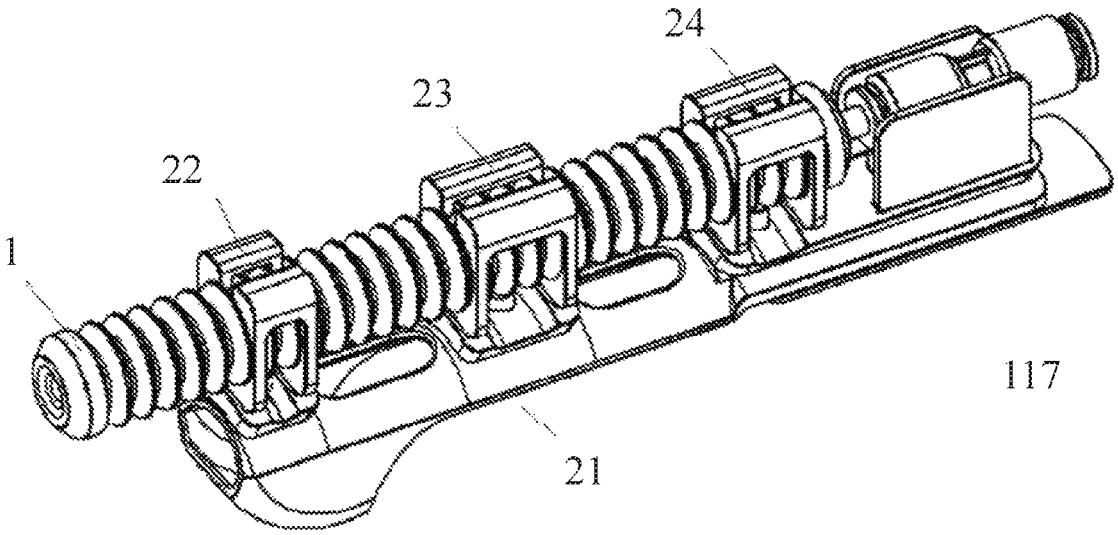
FIG. 9 is a structural diagram of a finger joint rehabilitation exercise aid part to be worn on a thumb.

FIG. 9 is a finger joint rehabilitation exercise aid part to be worn on the thumb, which comprises a rubber part 21, a small bracket 22, a middle bracket 23 and a large bracket 24, wherein the small bracket 22, the middle bracket 23 and the large bracket 24 are fixed on the rubber part 21, and the power source corrugated tube 3 is fixed with the small bracket 22, the middle bracket 23 and the large bracket 24.

Figure 10:
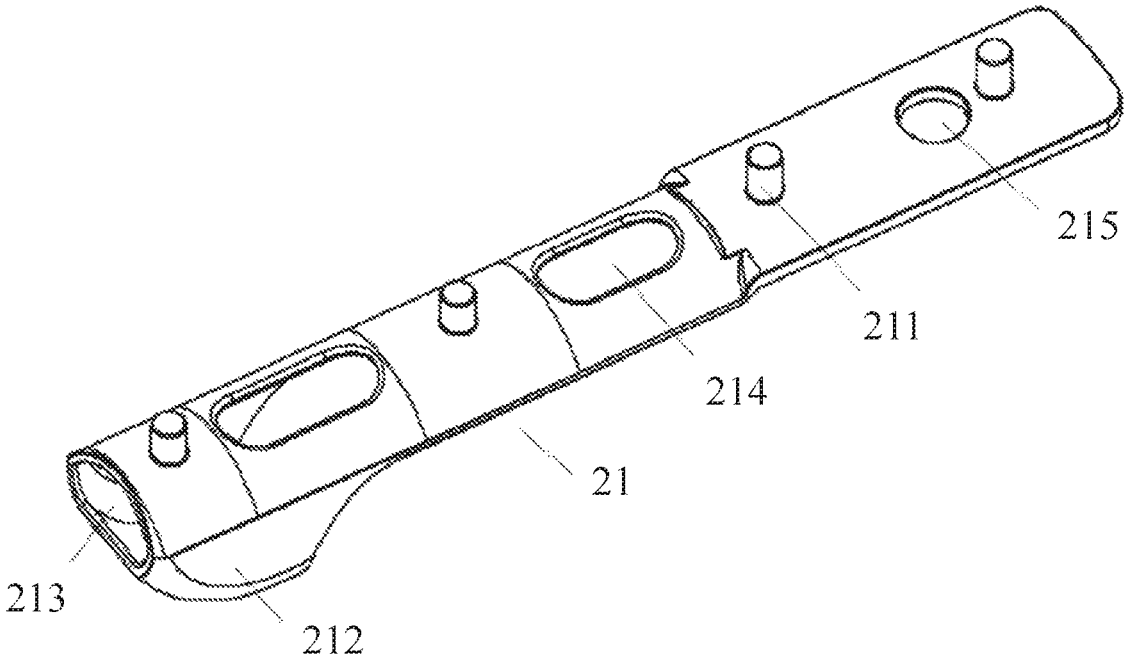
FIG. 10 is a structural diagram of a rubber part to be worn on a thumb.

FIG. 10 is a rubber part 21 to be worn on the thumb. The thumb has only three joints, including the distal phalanx, the proximal phalanx and the metacarpal bone. Since the distal phalanx is relatively short, a small bracket 22 is provided on the rubber part 21 to fix the power source (corrugated tube); since the proximal phalanx and the metacarpal bone are relatively long, the middle bracket 23 is provided on the rubber part at a position corresponding to the proximal phalanx close to the first joint of the thumb so as to fix the power source (corrugated tube), and the large bracket 24 is provided on the rubber part 21 at a position corresponding to the end of the proximal phalanx and the metacarpal bone so as to fix the power source (corrugated tube); and the rubber part 21 to be worn on the thumb is provided with four raised cylinders 211 (the same as the cylinder 111) respectively used for fixing the small bracket 22, the middle bracket 23 and the large bracket 24. As such, the small bracket with a smaller length is provided on the rubber part at the position corresponding to the shorter distal phalanx, and the middle bracket 23 and the large bracket 24 are respectively provided on the rubber part at the position corresponding to the longer proximal phalanx and the metacarpal bone, so that the rubber part fit more closely to the power source, which is more advantageous for controlling the deformation of the rubber part to allow the rubber part to fit on the finger, so that the power source (corrugated tube) controls the bending and stretching of the finger. The rubber part 21 is provided with a ring hole 214 (the same as the ring hole 114) is provided between the small bracket 22 and the middle bracket 23 and/or between the middle bracket 23 and the large bracket 24, the rubber part 11 to be worn on other fingers is provided with three ring holes, and providing the ring holes is advantageous for improving the fitting of the rubber part to the patient's finger. The rubber part 21 is also provided with a finger sheath 212, with a front end thereof having an opening 213, so that the patient's finger reaches into the finger sheath 212, and the fingertip is exposed out of the opening 213, the finger being exposed to the outside improving the patient's finger touch, which is advantageous for the rehabilitation of the patient. Also, the rubber part 21 is provided with a hole 215, such that the rubber part 21 is fixed, through the hole 215, together with other aid parts. The small bracket, the middle bracket and the large bracket to be worn on the thumb have the same structure and size as those to be worn on other fingers.

As such, the finger joint rehabilitation exercise aid part to be worn on the thumb is driven by the power source to bend and stretch and at the same time, drives the patient's fingers to perform bending and stretching exercise, thereby helping the patient perform rehabilitation training.

The apparatus that controls the air pressure in the corrugated tube is any apparatus that can perform suction, compression and exhaust, such as an electric air pump, a manual air pump, a foot-operated air pump, etc.

The above are only the preferred embodiments of the present invention, and are merely illustrative but not restrictive for the present invention. It will be understood by those skilled in the art that many changes, modifications and equivalents can be made within the spirit and scope as defined by the claims of the present invention, but will fall within the scope of protection of the present invention.

What is claimed is:

1. A finger joint rehabilitation exercise aid part, comprising:

a rubber part, a small bracket, a middle bracket and a large bracket, wherein the small bracket, the middle bracket and the large bracket are fixed on the rubber part, and positions of the small bracket, the middle bracket and the large bracket fixed on the rubber part respectively correspond to a distal phalanx, a middle phalanx, a proximal phalanx and a metacarpal bone;

the small bracket, the middle bracket and the large bracket are provided with a fixing hole for fixing a power source, respectively;

the rubber part is further provided with a first hole;

a front end of the rubber part is provided with a finger sheath—configured to receive a patient's finger;

a first curved surface on a reverse side of the rubber part has a greater curvature than a second curved surface on an obverse side of the rubber part, facilitating fitting to the patient's finger; and an annular opening is provided between the small bracket and the middle bracket and/or between the middle bracket and the large bracket in the rubber part, and the rubber part with the annular opening is configured to tightly fit to the patient's finger when the patient's finger bends and spreads, for helping the patient to perform follow actions with an aid of the finger joint rehabilitation exercise aid part.

2. The finger joint rehabilitation exercise aid part according to claim 1, wherein a front end of the finger sheath has an opening for receiving the patient's finger.

3. The finger joint rehabilitation exercise aid part according to claim 2, wherein the rubber part is provided with at least four raised cylinders, and the small bracket, the middle bracket and the large bracket are all provided with second holes for matching with the at least four raised cylinders.

4. The finger joint rehabilitation exercise aid part according to claim 3, wherein the small bracket, the middle bracket and the large bracket are all made of a lightweight material.

5. The finger joint rehabilitation exercise aid part according to claim 2, wherein the small bracket, the middle bracket and the large bracket are all made of a lightweight material.

6. The finger joint rehabilitation exercise aid part according to claim 1, wherein the small bracket, the middle bracket and the large bracket are all made of a lightweight material.

* * * * *